US005214860A

United States Patent [19]

Landes

[11] Patent Number: 5,214,860

[45] Date of Patent: Jun. 1, 1993

[54] CAST DRYING DEVICE AND METHOD OF USE

[76] Inventor: Mark J. Landes, 9404 Pond Rd. N., Bemidji, Minn. 56601

[21] Appl. No.: 893,703

[22] Filed: Jun. 5, 1992

[51] Int. Cl.[5] ..... F26B 7/00

[52] U.S. Cl. ..... 34/21; 34/202; 34/104; 34/243 R; 128/402

[58] Field of Search ..... 34/103, 104, 107, 201, 34/202, 21, 29, 34, 243 R, 99; 128/379, 381, 382, 399, 400, 402, 368

[56] References Cited

U.S. PATENT DOCUMENTS

| | | | |
|---|---|---|---|
| 2,706,988 | 4/1955 | Weber | 34/202 |
| 3,307,554 | 3/1967 | Thornton et al. | 128/402 |
| 3,609,879 | 10/1971 | Hanisco | 34/99 |
| 3,711,958 | 1/1973 | Lepage | 34/243 R |
| 4,572,188 | 2/1986 | Augustine et al. | 34/99 |
| 4,871,900 | 10/1989 | Hickman | 34/202 |

*Primary Examiner*—Henry A. Bennett
*Assistant Examiner*—Denise Gromada
*Attorney, Agent, or Firm*—Merchant, Gould, Smith, Edell, Welter & Schmidt

[57] ABSTRACT

A cast drying system is disclosed for drying a cast. The cast drying system includes a cast drying device including an inflatable bladder made of a flexible material, the bladder having an outer wall and an inner wall jointed together to define an enclosed expansion chamber. The inflatable bladder further includes first air passage means for permitting air to pass into the inflatable bladder which communicates with the expansion chamber. The inner wall preferably includes second air passage means for permitting air to pass out of the expansion chamber such that air originating from the source of forced air can be directed against a cast when the cast is engaged with the inner wall of the inflatable bladder. The system further includes coupling means for conveying forced air originating from the source of forced air into the expansion chamber. The process for drying a cast is also disclosed. The process includes the steps of engaging the cast with the inflatable bladder and interconnecting the drying device with the source of forced air such that air originating from the source of forced air passes through the bladder and into the cast to dry the cast.

18 Claims, 2 Drawing Sheets

CAST DRYING DEVICE AND METHOD OF USE

FIELD OF THE INVENTION

This invention pertains generally to a device for drying a cast used to immobilize or restrain body members. This invention also pertains to a process for drying such a cast.

BACKGROUND OF THE INVENTION

Casts are widely used in the medical field to immobilize or restrain body parts which have suffered injury or are otherwise in need of immobilization or restraint. Casts were traditionally constructed of medical gauze and a plaster of paris compound. A significant disadvantage of plaster of paris casts was their inability to maintain structural integrity upon prolonged exposure to or immersion in water or other liquids. This inability prevented persons in casts from engaging in daily activities such as showering or bathing. The inability to withstand exposure to liquids caused special hardship to active people, especially young adults and children because it prevented them from participating in water activities such as swimming, boating, or water-skiing. Furthermore, even when not exposed to external sources of water or moisture, active individuals wearing casts often perspire under the cast, creating a source of moisture on the surface of the skin inside the cast. This moisture generally includes salts and other biological chemicals which can build up on the skin and cause an irritation such as "itching" which can be bothersome to the individual.

More recent cast construction techniques employ a three-part cast typically comprising: (a) a non-rigid sleeve consisting of a cloth padding as an underlayer dressing material placed onto the body surface; (b) a layer of resilient padding positioned around this underlayer; and (c) a rigid outer immobilizing layer typically consisting of a cured fiberglass webbing material.

Although fiberglass casts generally maintain their structural integrity when exposed to or immersed in water or other liquids, physicians and other medical practitioners continue to advise patients to avoid significant contact with water or other liquids. Reasons for avoiding prolonged contact with water can include the following: (a) when wet, the inner cloth sleeve and layer of resilient padding may act as a host for bacteria, thereby serving as a source of infection; (b) when wet, the inner sleeve and layer of resilient padding may prevent adequate air flow to the skin of the surrounded body member, thereby damaging the general health of the skin.

Thus, although improved cast construction techniques have minimized the risk of damage to the cast resulting from exposure to or immersion in liquids, practitioners mindful of the risk set forth above, and perhaps conditioned to provide advice which was very important in the past when casts were commonly made of plaster of paris continue to advise people wearing casts to avoid exposing the cast to water when showering, swimming, or boating. Therefore, in spite of the changes in cast construction, this problem continues to impose serious hardship on persons required to wear casts to immobilize injured limbs who enjoy aquatic sports such as swimming, water skiing, or boating. The present invention provides solutions to these and other problems.

SUMMARY OF THE INVENTION

The present invention provides a simple and inexpensive solution which minimizes the risks associated with bacterial infection or skin damage which can result from exposing the cast to water or other liquids, thereby allowing the person to shower, swim, or otherwise expose the cast to water. The present invention provides a cast drying device for use with a source of forced air. The cast drying device comprises an inflatable bladder made of a flexible material which restrains the flow of air. In the preferred embodiments the bladder is generally cylindrical. The bladder has an outer wall and an inner wall which are sealed together to define an enclosed expansion chamber. In the preferred embodiment, the inner wall separates the expansion chamber from an inner lumen. The bladder further includes a first air passage means for permitting air to pass into said bladder from the source of forced air. The inner wall includes second air passage means for permitting air to pass out of the expansion chamber. The second air passage means preferably include multiple air passage or air outlet openings located in the inner wall which permit air to pass out of the expansion chamber and preferably into the inner lumen. In this way, air can be directed through the cast via said second air passage means when the cast is engaged within the inner lumen of the preferred embodiment.

The present invention provides a safe, effective, and inexpensive solution to the previously discussed problems associated with wearing casts. The preferred embodiment is constructed of inexpensive, readily available materials and operates with readily available sources of forced air such as a blower designed to provide hot air, preferably both hot and cool air. Although not preferred, even a common hair blow-dryer or a vacuum cleaner, used on a reversed air flow cycle, can be used as a source of forced air. The preferred embodiment allows the user to dry a cast anywhere the user can access a source of forced air. Furthermore, the forced air drying method dries the cast safely and effectively while aerating the skin. This can be important both to prevent any potential ill effects of exposing a cast to water, but also as a solution used to enable users to wash unexposed skin within the cast to remove salts which build up on the inside of the cast and might otherwise irritate the skin. These and various other advantages and features of novelty which characterize the present invention are pointed out with particularity in the claims annexed hereto and forming a part hereof. However, for a better understanding of the present invention, its advantages, and other objects obtained by its use, reference should be made to the drawings which form a further part hereof, and to the accompanying descriptive matter, in which there is illustrated and described a preferred embodiment of the present invention.

BRIEF DESCRIPTION OF THE DRAWINGS

Referring to the drawings, wherein like numerals represent like parts throughout the several views.

DETAILED DESCRIPTION OF THE PREFERRED EMBODIMENT

Figure 1:
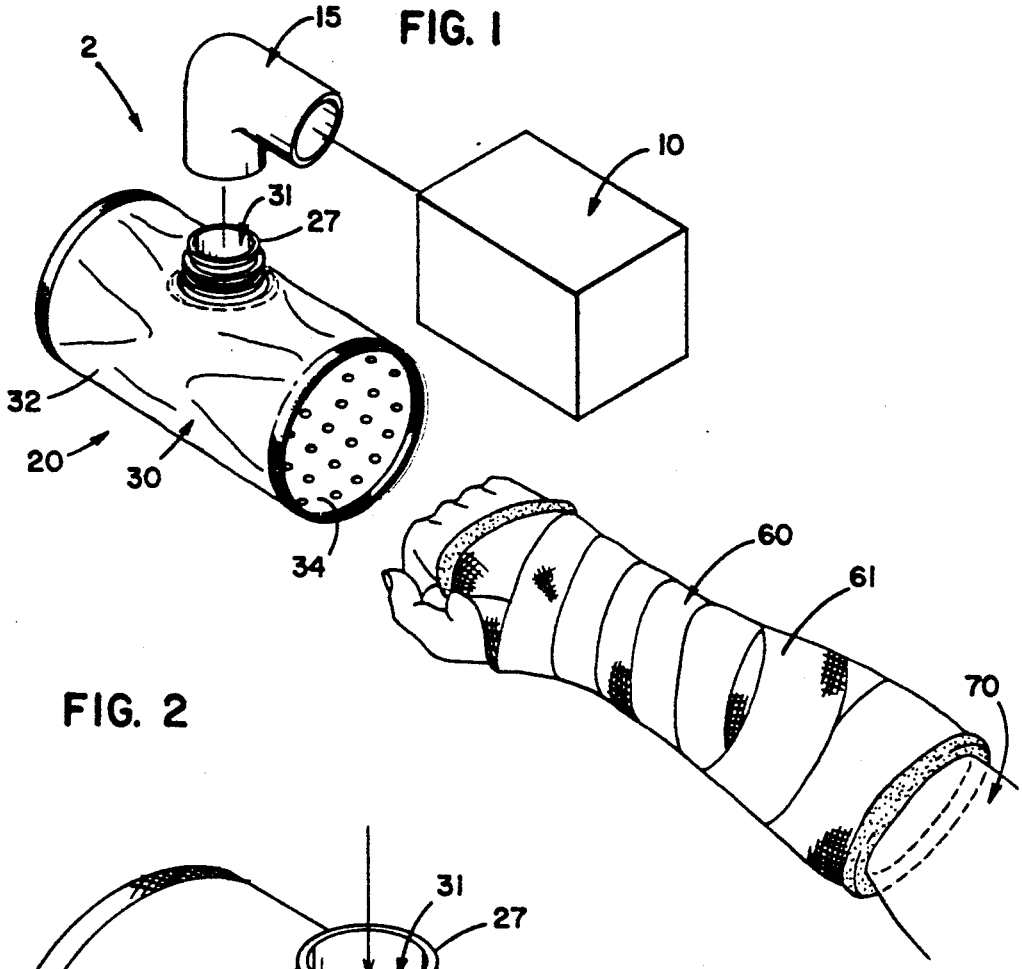
FIG. 1 is an exploded perspective view of the drying device of the present invention, a coupling device used to couple an air inlet with a source of forced air.
Figure 2:
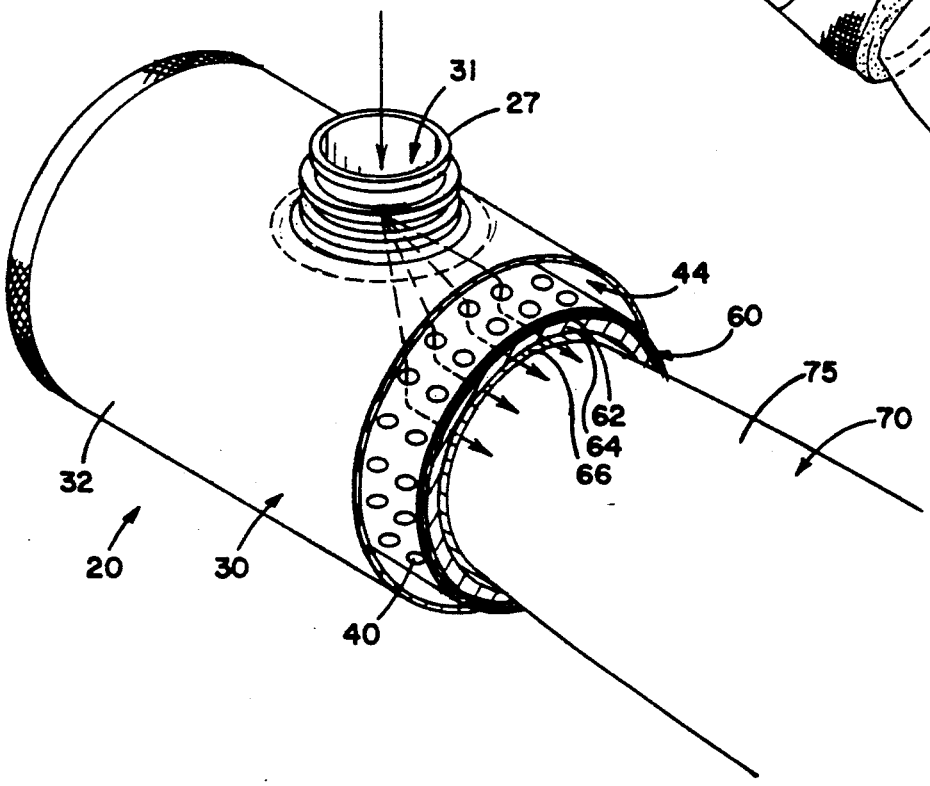
FIG. 2 is a perspective view of a portion of the drying device shown in FIG. 1 as it would appear fully inflated and surrounding a cast on a body member.

Referring now to the drawings, and to FIGS. 1 and 2 in particular, a preferred cast drying system 2 is shown generally. The cast drying system 2 is used to dry a cast 60 which is used to immobilize fractured or otherwise traumatized limbs or other body parts. It will be appreciated that the cast 60 shown in FIG. 1 is exemplary only and that cast drying systems can be designed to dry casts of any shape or dimension and remain within the scope of the present invention. Commonly used casts today, such as the cast 60 shown in FIGS. 1 and 2, have a fiber glass exterior layer 62, a cushion layer 64, preferably of cotton or the like, and fabric inner layer 66 which is folded over the cushion or insulation layer 64 at the ends of the cast 60 before the fiber glass exterior layer is added.

The preferred cast drying system 2 includes a source of forced air, generally represented by the reference numeral 10, a coupling device 15 and a cast drying device 20. When used to dry a cast 60, the cast drying device 20 is engaged with the cast and interconnected with the source of forced air 10 such that air originating from the source of forced air 10 preferably passes through the coupling device 15 and into the drying device 20. The drying device 20 includes an inflatable bladder 30 having an outer wall 32 and an inner wall 34.

In the preferred embodiment, the drying device 20 is a bladder 30 having an outer wall 32, including an air inlet coupling, and an inner wall 34 which form a substantially cylindrical chamber 50 which surrounds the cast 60 when engaged therewith. The preferred device 20 has a generally cylindrical shape and is about ten inches in length and about four inches in diameter when engaged with a cast. However, one of ordinary skill in the art will recognize that the bladder could take any size or shape which would effectively engage the surface of a cast so as to force air to flow against the surface of the cast and into and through the cast. It will also be appreciated that the present invention need not be a generally cylindrical bladder as shown, but could be a simple bladder (not shown) including an expansion chamber which can be wrapped around the cast and secure in place appropriate means for same. The coupling device 15 is secured to the air inlet coupling 27, which includes an air inlet opening 31 through which air originating from the source of forced air 10 can pass into an expansion chamber 44, within the inflatable bladder 30, defined by the outer wall 32 and the inner wall 34. The coupling device 15 is preferably a flexible hose (not shown).

When air is forced into the inflatable bladder 30 via the air inlet opening 31, the air enters the expansion chamber 44 located between the outer and inner walls 32 and 34 which are sealed together to define the expansion chamber 44. The inner wall 34 preferably includes a plurality of air outlet openings 40 which allow air to pass out of the expansion chamber 44 and into space adjacent to the inner wall 34, preferably cylindrical chamber 50. It will be appreciated, however, that the embodiments of the present invention including simple inflatable bladders (not shown) which do not have the generally cylindrical shape of the preferred embodiment, will simply allow air to pass through the inner wall 34 and into the adjacent space. In either case, when the adjacent space is occupied by a cast 60, as shown for the preferred embodiment in FIG. 2, the cast 60 will at least partially impede the flow of air passing through the expansion chamber 44, so that the expansion chamber 44 will expand. As the expansion chamber 44 expands, the inner surface will be further engaged with the cast 60 so that air passing out of the expansion chamber 44 and through the inner wall 34 via the air outlet openings 40 will be further impeded when passing out of the expansion chamber because the inner wall 34 will be forced up against an outer surface 61 of the cast 60 so that it is very difficult for the air to pass out of the expansion chamber 44 without passing into the cast 60 thereby aerating inner portions of the cast and the outer surface or skin 75 of the body part 70 which is immobilized within the cast 60. It will be appreciated, therefore, that the expansion chamber 44 is an important element of the present invention, because the expansion chamber operates to expand when air is forced into the bladder 30 and the inner wall 34 which contains the plurality of air outlet openings 40, is engaged with the cast. If the inner wall 34 is not pressed against the cast 60 when the expansion chamber 44 is expanded, the air will simply pass out of the expansion chamber 44 via the air outlet openings 40 and it is unlikely that the expansion chamber 44 will fully expand. In order to fully expand the expansion chamber 44, it is necessary to impede the flow of air out of the air outlet openings 40 unless the air pressure within the expansion chamber 44 is substantially greater than that generated by a common blower or hair dryer. When the cast 60 is used to impede the flow of air out of the air outlet openings 40, the air is forced into the cast 60 in a manner which is designed to be effective to dry the cast 60 and the skin 75 proximate the cast.

The preferred drying device 20 is preferably constructed of synthetic sheet material which provides sufficient strength, flexibility, and resistance to air flow for the intended use. Preferred embodiment sheet materials made from polyurethane, polypropylene, and the like can be used to make the present device. However, those skilled in the art will recognize that other plastics, polymers, vinyl, papers, or other materials having the preferred characteristics of strength, flexibility, and impermeability to air flow will be suitable substitute materials.

The outer wall 32 of the preferred drying device 20 includes a circular air flow passage 31 approximately 1.25 inches in diameter which provides an opening 31 for air to flow into the expansion chamber 44. It will be appreciated, however, that bladders (not shown) of different sizes or shapes might require multiple air flow passages of various shapes or diameters to provide sufficient air flow to inflate the bladder.

The source of forced air 10 will preferably be a blower (not shown) capable of providing either hot or cool air, as selected by the user. Such a blower will preferably have a capacity greater than that of a common hair dryer.

In the preferred embodiment, the air inlet coupling 27 of the outer wall 32 includes a connector 27 which enables the coupling device 15 to be attached to the bladder 30. The connector 27 is preferably of a generally cylindrical shape suitable for engagement with the air inlet coupling 27.

The connector 27 preferably includes a mechanism for securely attaching the coupling device 15 to the bladder 30 so as to allow forced air to flow through the coupling device 15 and connector 27 into the expansion chamber 44. It will be appreciated that the connector 15 could take different shapes or sizes and that alternative means could be used to securely engage the coupling device 15 to the bladder 30.

In the preferred embodiment the inner wall 34 of the inflatable bladder 30 includes a plurality of air outlet openings 40 for forced air to flow from the expansion chamber 44 across the inner wall 34 and into the cast 60 when the inner wall 34 of the expansion chamber 44 is securely engaged with the cast 60. Each air outlet opening 40 is a hole in the inner wall 34 approximately one-half centimeter in diameter. The air outlet openings 40 are arranged on the inner wall 34 of the bladder 30 such that the forced air is evenly distributed along the surface 61 of the cast 60. Again, it will be appreciated that the air passages on the inner wall could take a different shape or arrangement on the inner wall to distribute the air in a different fashion along the surface 61 of the cast 60.

In the preferred embodiment the outer wall 32 is bonded along the circumference of each end the inflatable bladder 31 to the inner wall 34 to form an airtight seal 36. The outer and inner walls 32 and 34 cooperate to form the expansion chamber 44. A heat sealing process is preferably used to bond the various elements of the device to one another. However, it will be appreciated that other bonding processes which provide a sufficiently strong bond for the intended use will be suitable substitute processes.

FIG. 2 depicts the preferred cast drying system 2 in operation. With the inflatable bladder deflated as shown in FIG. 1, the drying device 20 is positioned such that the immobilized body member 70 and the cast 60 are in the cylindrical chamber or inner lumen 50 of the drying device 20. A source of forced air 10 is then interconnected to the air inlet opening 31 located on the outer wall 32. Air is then forced through the air inlet opening 31 in the outer wall 32 and into the expansion chamber 44, the presence of the cast 60 in the inner lumen 50 restricts the exit flow of air through the air outlet openings 40 of the inner wall, thereby causing the expansion chamber 44 to inflate. Inflating the expansion chamber 44 in this manner forces the inner wall 34 to engage the outer surface 61 of the cast 60. Once the inner wall 34 has securely engaged the outer surface 61 of the cast 60, the forced air flows through the air outlet openings 40 into the cast 60.

By forcing air through the cast 60 the drying device 20 facilitates the evaporation of liquids which have been absorbed by the resilient inner layers of the cast or otherwise trapped within the cast or against the skin of the immobilized body member. The prompt drying of the inner layers 64 and 66 of the cast 60, along with the outer fiberglass layer 62 minimizes the possibility that the cast 60 will act as a host for bacteria which may cause infection or illness. Furthermore, the ability to wash the skin 75 within the cast 60 allows for the removal of salts and other biological waste materials secreted by the skin 75 when the body perspires.

Figure 3:
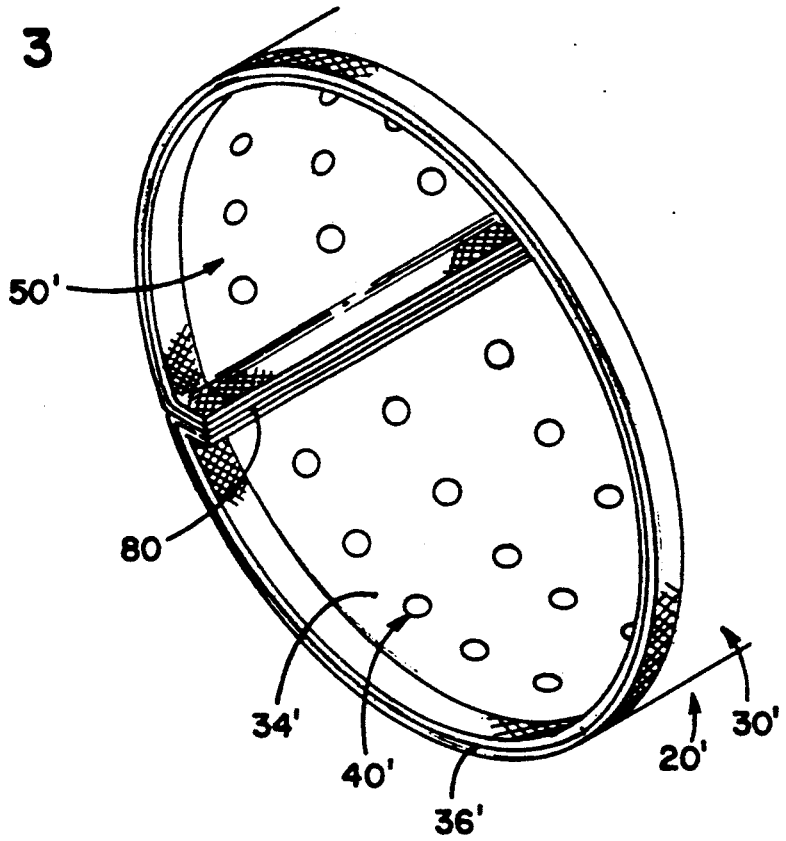
FIG. 3 is a perspective view of a portion of an alternate embodiment of the drying device shown in FIG. 1.

FIG. 3 represents an alternative embodiment of the drying device 20' in which the outer wall 32' is bonded to the inner wall 34' to form an airtight seal along a longitudinal axis along the inner wall 34' of the inflatable bladder 30' to form a longitudinal seem 80. Such an embodiment may represent a more cost-effective method of manufacturing the device because it allows the inner and outer walls 32' and 34' of the bladder 30' to be formed into a cylindrical shape in a single step rather than forming the inner and outer walls into a cylindrical shape individually. However, this embodiment does not alter the method or principles of operation of the device. In fact, it will be appreciated that an inflatable bladder of a generally flat or planar shape and construction could be used within the scope of the present invention if it was secured around the cast in such a way to insure a generally even flow of air into various portions of the cast 60 which is to be dried at any one time.

It is to be understood, that even though numerous characteristics and advantages of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed.

What is claimed is:

1. A combination cast and cast drying device for use in combination with a source of forced air, said combination cast and cast drying device comprising:

a cast; and an inflatable bladder made of a flexible material which restrains the flow of air, said bladder having an outer wall and an inner wall joined together to define an enclosed expansion chamber and first air passage means for permitting air to pass into said bladder from the source of forced air, said air passage means communicating with said expansion chamber, said inner including second air passage means for permitting air to pass out of said expansion chamber wherein air originating from the source of forced air can be directed against the cast via said second air passage means when the cast is engaged with the inner wall.

2. The combination cast and cast drying device of claim 1 wherein the bladder is generally cylindrical, said inner wall separating the expansion chamber from an inner lumen passing through the generally cylindrical bladder.

3. The combination cast and cast drying device of claim 2 wherein said first air passage means includes an air inlet through the outer wall.

4. The combination cast and cast drying device of claim 3 wherein said air inlet includes coupling means for coupling to conduit means for conveying forced air originating from the source of forced air.

5. The combination cast and cast drying device of claim 2 wherein said second air passage means includes a plurality of air passages which permit a plurality of air streams to pass out of the expansion chamber into the inner lumen across the inner wall.

6. A combination cast and cast drying device for use in combination with a source of forced air, said combination cast and cast drying device comprising:

a cast;

a generally cylindrical bladder made of a flexible material which restrains the flow of air, said bladder having an outer wall and an inner wall joined together to form an enclosed expansion chamber, said inner wall separating the expansion chamber from an inner lumen; and first air passage means for permitting air to pass into said bladder from the source of forced air said first air passage means communicating with said expansion chamber;

wherein said inner wall includes second air passage means for permitting air to pass out of aid expansion chamber and into the inner lumen, wherein air originating from the source of forced air can be directed against the cast via said second air passage means when the cast is engaged with the inner wall within the inner lumen.

7. The combination cast and cast drying device of claim 6 wherein the expansion chamber encircles the inner lumen.

8. The combination cast and cast drying device of claim 6 wherein said first air passage means includes an air inlet through the outer wall.

9. The combination cast and cast drying device of claim 8 wherein said air inlet includes coupling means for coupling to conduit means for conveying forced air originating from the source of forced air.

10. The combination cast and cast drying device of claim 6 wherein said second air passage means includes a plurality of air passages which permit a plurality of air streams to pass out of the expansion chamber into the inner lumen across the inner wall.

11. A combination cast and cast drying device for use with a source of forced air, said combination cast and cast drying device comprising:

a cast; and a generally cylindrical bladder made of a flexible material which restrains the flow of air, said bladder having an outer wall and an inner wall joined together to enclose an expansion chamber; the inner wall separating the expansion chamber from an inner lumen; said bladder having first air passage means for permitting air to pass into said bladder from the source of forced air, said inner wall including second air passage means for permitting air passing into the expansion chamber via said first air passage means to pass out of the expansion chamber and into the inner lumen, wherein air can be directed against the cast via said second air passage means when the cast is located within the inner lumen.

12. The combination cast and cast drying device of claim 11 wherein the expansion chamber encircles the inner lumen.

13. The combination cast and cast drying device of claim 11 wherein said first air passage means includes an air inlet through the outer wall.

14. The combination cast and cast drying device of claim 13 wherein said air inlet includes coupling means for coupling to conduit means for conveying forced air originating from the source of forced air.

15. The combination cast and cast drying device of claim 11 wherein said second air passage means includes a plurality of air passages which permit a plurality of air streams to pass out of the expansion chamber into the inner lumen across the inner wall.

16. A process for drying a cast, said process comprising the steps of:

(a) engaging the cast with an inflatable bladder, the inflatable bladder including first air passage means for permitting air originating from a source of forced air to pass into the inflatable bladder, and an inner wall including second air passage means for permitting air to pass out of the inflatable bladder;

(b) interconnecting said drying device with the source of forced air such that air originating from the source of forced air passes through the bladder and into the cast via said second air passage means to dry the cast.

17. The process of claim 16 wherein the inflatable bladder is a generally cylindrical bladder, and wherein the step of engaging the cast includes surrounding the cast with the generally cylindrical bladder.

18. The process of claim 16 wherein the inflatable bladder can be secured around the cast so as to generally surround the cast.

* * * * *